US009664068B2

(12) United States Patent
Burdgick et al.

(10) Patent No.: US 9,664,068 B2
(45) Date of Patent: May 30, 2017

(54) CASING SUPPORT BLOCK FOR STEAM TURBINE NOZZLE ASSEMBLY

(71) Applicant: General Electric Company, Schenectady, NY (US)

(72) Inventors: Steven Sebastian Burdgick, Schenectady, NY (US); Jesus Mendoza, Queretaro (MX); John Paul Davis, Duanesburg, NY (US); Stephen Roger Swan, Ballston Lake, NY (US)

(73) Assignee: General Electric Company, Schenectady, NY (US)

( * ) Notice: Subject to any disclaimer, the term of this patent is extended or adjusted under 35 U.S.C. 154(b) by 358 days.

(21) Appl. No.: 14/567,711

(22) Filed: Dec. 11, 2014

(65) Prior Publication Data

US 2016/0169047 A1 Jun. 16, 2016

(51) Int. Cl.

| | |
|---|---|
| ***F01D 5/02*** | (2006.01) |
| ***F01D 25/28*** | (2006.01) |
| ***F01D 25/00*** | (2006.01) |
| ***F01D 25/24*** | (2006.01) |

(52) U.S. Cl.

CPC ..... *F01D 25/28* (2013.01); *F01D 25/002* (2013.01); *F01D 25/246* (2013.01); *F05D 2220/31* (2013.01)

(58) Field of Classification Search

CPC ..... F01D 25/28; F01D 25/246; F01D 25/002; F05D 2240/31

USPC ..... 415/209.2

See application file for complete search history.

(56) References Cited

U.S. PATENT DOCUMENTS

| | | | | |
|---|---|---|---|---|
| 7,329,098 | B2 | 2/2008 | Burdgick | |
| 2008/0317591 | A1 | 12/2008 | Golinkin et al. | |
| 2011/0250063 | A1* | 10/2011 | Burdgick | F01D 25/246 415/209.2 |
| 2013/0108437 | A1 | 5/2013 | Golinkin et al. | |

* cited by examiner

*Primary Examiner* — Gregory Anderson
*Assistant Examiner* — Maxime Adjagbe
(74) *Attorney, Agent, or Firm* — Ernest G. Cusick; Hoffman Warnick LLC

(57) ABSTRACT

A support block for a steam turbine casing, a related assembly and apparatus. Various embodiments include a steam turbine casing support block having: a body portion sized to substantially fill a pocket in a steam turbine casing, the body portion having a greater length than a depth or a width; a set of tabs extending from the body portion, each of the set of tabs sized to substantially fill a corresponding slot in the steam turbine casing, wherein the set of tabs are located at a radially outwardly facing wall of the body portion; and a pin hole on a bottom surface of the body portion for receiving a retaining member.

19 Claims, 12 Drawing Sheets

CASING SUPPORT BLOCK FOR STEAM TURBINE NOZZLE ASSEMBLY

BACKGROUND OF THE INVENTION

The subject matter disclosed herein relates to a steam turbine nozzle assembly, or diaphragm stage. Specifically, the subject matter disclosed herein relates to a casing support block for a steam turbine nozzle assembly.

Steam turbines include static nozzle assemblies that direct flow of a working fluid into turbine buckets connected to a rotating rotor. The nozzle construction (including a plurality of nozzles, or "airfoils") is sometimes referred to as a "diaphragm" or "nozzle assembly stage." Steam turbine diaphragms include two halves, which are assembled around the rotor, creating horizontal joints between these two halves. Each turbine diaphragm stage is vertically supported by support bars, support lugs or support screws on each side of the diaphragm at the respective horizontal joints. The horizontal joints of the diaphragm also correspond to horizontal joints of the turbine casing, which surrounds the steam turbine diaphragm.

Support bars are typically attached horizontally to the bottom half of the diaphragm stage near the horizontal joints by bolts. The typical support bar includes a tongue portion that fits into a pocket which is machined into the diaphragm. This support bar also includes an elongated portion which sits on a ledge of the turbine casing. Performing diaphragm maintenance may require accessing the bottom half of the diaphragm, which is incapable of rotating about the turbine rotor due to the support bars and a centering pin coupling the bottom half of diaphragm to the casing. Additionally, removal of the bottom half of the diaphragm may also be necessary in order to align the bottom half with the horizontal joint of the casing. In order to access the bottom half of the diaphragm, a number of time-consuming and costly steps could be undertaken.

BRIEF DESCRIPTION OF THE INVENTION

A support block for a steam turbine casing, a related assembly and apparatus. Various embodiments include a steam turbine casing support block having: a body portion sized to substantially fill a pocket in a steam turbine casing, the body portion having a greater length than a depth or a width; a set of tabs extending from the body portion, each of the set of tabs sized to substantially fill a corresponding slot in the steam turbine casing, wherein the set of tabs are located at a radially outwardly facing wall of the body portion; and a pin hole on a bottom surface of the body portion for receiving a retaining member.

A first aspect of the disclosure includes a steam turbine casing support block having: a body portion sized to substantially fill a pocket in a steam turbine casing, the body portion having a greater length than a depth or a width; a set of tabs extending from the body portion, each of the set of tabs sized to substantially fill a corresponding slot in the steam turbine casing, wherein the set of tabs are located at a radially outwardly facing wall of the body portion; and a pin hole on a bottom surface of the body portion for receiving a retaining member.

A second aspect of the disclosure includes a steam turbine nozzle support assembly having: a semi-annular diaphragm segment; a steam turbine casing at least partially housing the semi-annular diaphragm segment, the steam turbine casing having a horizontal joint surface and a pocket below the horizontal joint surface, the pocket including a main pocket and at least one slot extending from the main pocket; and a steam turbine casing support block having: a body portion sized to substantially fill the main pocket; and a set of tabs extending from the body portion, each of the set of tabs sized to substantially fill the at least one slot extending from the main pocket, wherein the set of tabs are located at a radially outwardly facing wall of the body portion.

A third aspect of the disclosure includes a steam turbine apparatus having: a rotor; a semi-annular diaphragm segment at least partially surrounding the rotor; a steam turbine casing at least partially housing the semi-annular diaphragm segment and the rotor, the steam turbine casing having a horizontal joint surface and a pocket below the horizontal joint surface, the pocket including a main pocket and at least one slot extending from the main pocket; a steam turbine casing support block having: a body portion sized to substantially fill the main pocket; and a set of tabs extending from the body portion, each of the set of tabs sized to substantially fill the at least one slot extending from the main pocket, wherein the set of tabs are located at a radially outwardly facing wall of the body portion; and a support bar non-affixedly engaging the semi-annular diaphragm segment, the support bar including a flange overhanging the horizontal joint surface of the steam turbine casing and the steam turbine casing support block.

BRIEF DESCRIPTION OF THE DRAWINGS

These and other features of this invention will be more readily understood from the following detailed description of the various aspects of the invention taken in conjunction with the accompanying drawings that depict various embodiments of the disclosure, in which.

Figure 1:
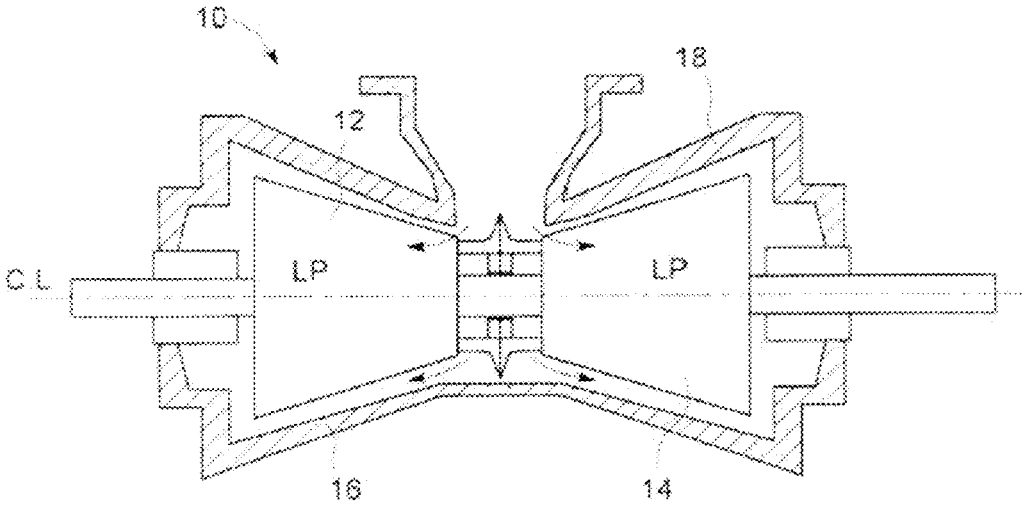
FIG. 1(PRIOR ART)
FIG. 1 shows a partial cross-sectional schematic of a double-flow steam turbine according to the prior art.

It is noted that the drawings of the invention are not necessarily to scale. The drawings are intended to depict only typical aspects of the invention, and therefore should not be considered as limiting the scope of the invention. In the drawings, like numbering represents like elements between the drawings.

DETAILED DESCRIPTION OF THE INVENTION

Aspects of the invention provide for a casing support block for a steam turbine nozzle assembly. This support block may be removably affixed to a semi-annular casing segment in a pocket, and may allow for retrofit of an older casing segment to a modern support bar design without the need to discard the older casing.

As noted herein, the conventional support bar design requires that the steam turbine rotor be removed in order to remove the lower diaphragm half, which leads to higher cycle time and associated costs. The fact that the support bars cannot be removed while the lower diaphragm half is in the turbine casing prevents the diaphragm from being rolled out around the rotor. Clearance issues with the horizontal bolts which hold the support bars prevent the support bars from being removed from the lower diaphragm half while it is still in the casing. Currently the process for diaphragm maintenance takes several shifts or days to complete. First the upper shell is removed, then the upper diaphragm half Next the rotor is removed to allow clearance, and then the lower diaphragm half is removed.

Figure 2:
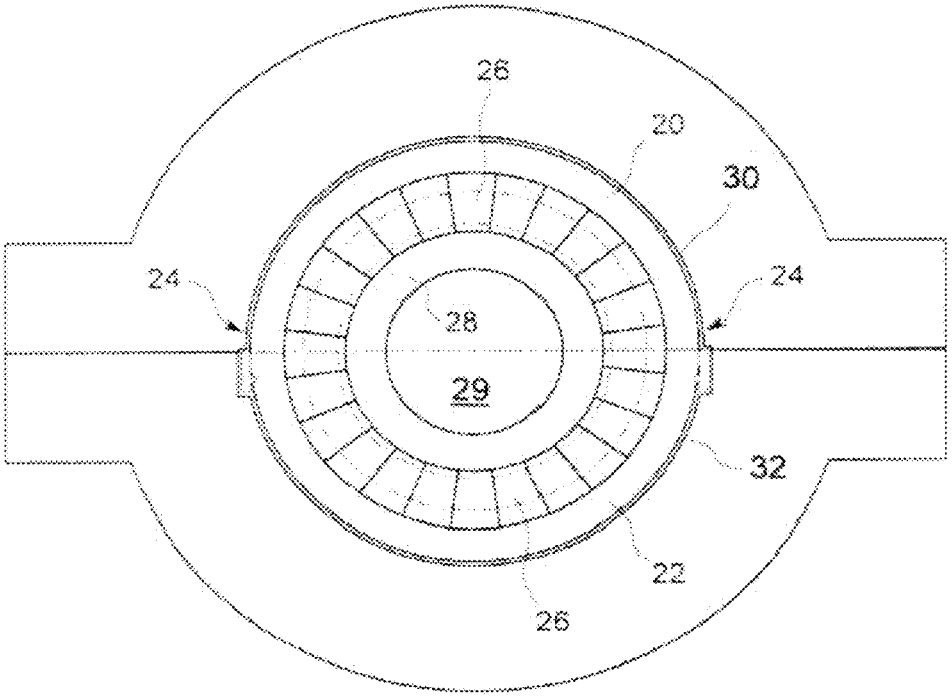
FIG. 2(PRIOR ART)
FIG. 2 shows a general schematic end elevation of a pair of annular diaphragm ring segments joined at a horizontal split surface according to the prior art.

The inventors have developed a support bar design that includes a centerline support element which rests above the horizontal joint surface of the casing segment. The support bar can be adjusted from a location above the horizontal joint surface, without requiring removal of the lower diaphragm half Turning to FIG. 1, a partial cross-sectional schematic of a double-flow steam turbine 10 (e.g., a low-pressure steam turbine) according to the prior art is shown. Double-flow steam turbine 10 may include a first low-pressure (LP) section 12 and a second LP section 14, surrounded by first and second diaphragm assemblies 16, 18, respectively (including casing sections and diaphragm ring segments housed therein). As shown in FIG. 2, each diaphragm assembly 16, 18 includes a pair of semi-annular diaphragm ring segments 20, 22, which are joined at a horizontal joint surface 24. Diaphragm ring segments 20, 22 are housed within casing segments 30, 32, respectively, which are also joined at horizontal joint surface 24. Each semi-annular diaphragm ring segment 20, 22, supports a semi-annular row of turbine nozzles 26 and an inner web 28, as is known in the art. The diaphragm ring segments 20, 22 collectively surround a rotor 29 (shown in phantom), as is known in the art.

Figure 3:
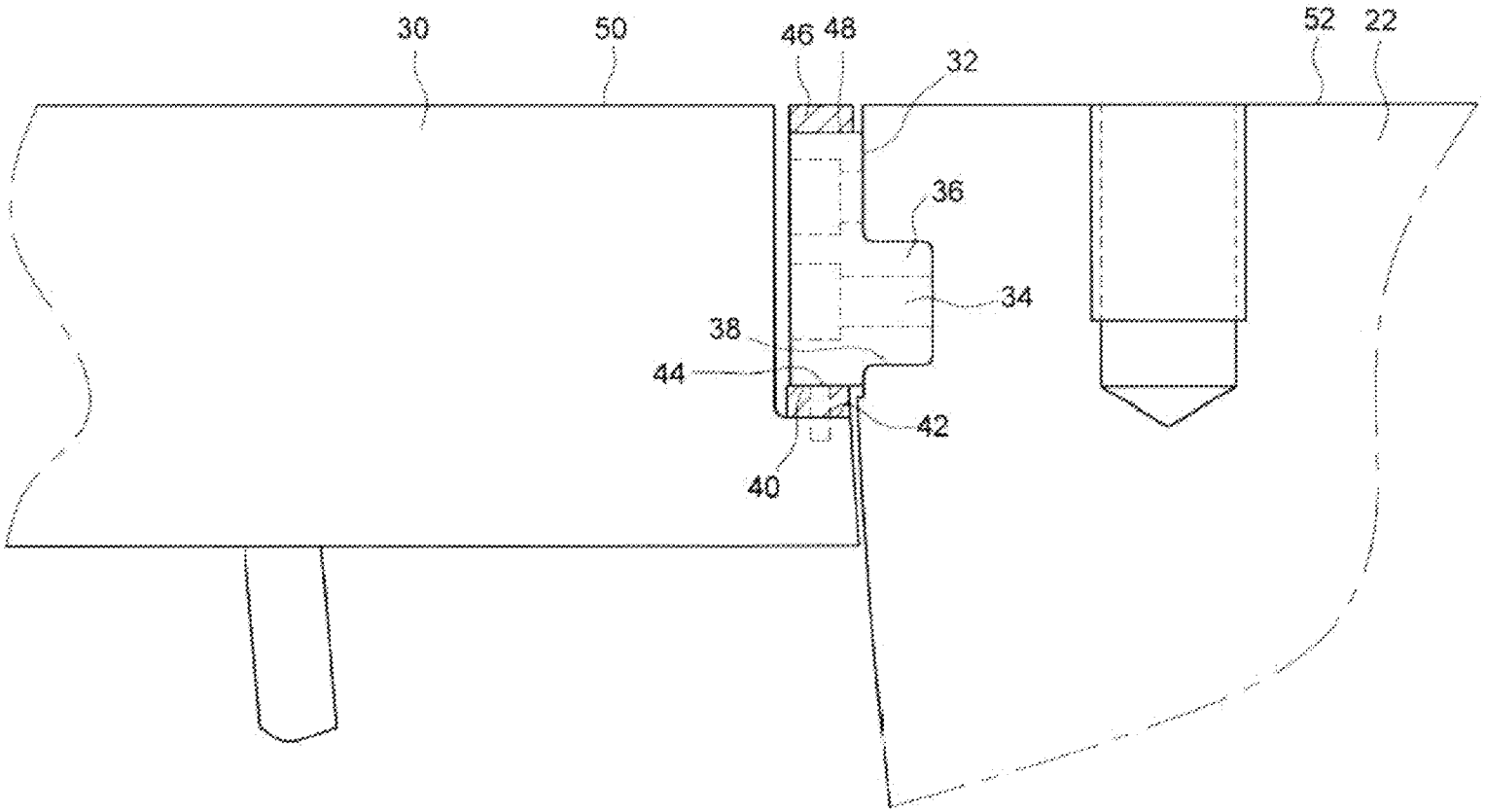
FIG. 3(PRIOR ART)
FIG. 3 shows a partial end elevation of a steam turbine nozzle support assembly according to the prior art.

Turning to FIG. 3, a prior art support assembly for a steam turbine diaphragm is shown. Specifically, FIG. 3 is a close-up view of a portion of the lower semi-annular diaphragm ring segment (or simply, lower diaphragm segment) 22 of FIG. 2, which is affixedly coupled to a lower turbine casing half (or simply, casing) 30. Lower diaphragm segment 22 is shown to be vertically supported within casing 30 by a support bar 32, as is known in the art. Support bar 32 is bolted to lower diaphragm segment 22 by bolt(s) 34 extending through support bar 32. At least one bolt 34 may extend through a radially inwardly directed flange 36 of support bar 32. Flange 36 is received in a mating slot 38 in lower diaphragm segment 22. Support bar 32 otherwise extends vertically along casing 30 on one side and diaphragm segment 22 on the other side. A lower surface 40 of the support bar faces a shoulder 42 formed in casing 30, with a shim block (or simply, shim) 44 interposed between shoulder 42 and lower surface 40. Shim 44 is typically bolted to casing 30. A second shim block 46 is shown seated on an upper surface 48 of support bar 32 to effectively make the upper end of support bar flush with horizontal joint surfaces 50, 52 of casing 30 and lower diaphragm segment 22, respectively. This arrangement allows support bar 32 to be sandwiched between the upper and lower casing sections (upper casing omitted). The other side of lower diaphragm segment 22 is similarly supported on the opposite side of the casing (other side omitted for clarity).

Performing vertical diaphragm alignment (alignment of horizontal joint surfaces 50, 52) or performing maintenance on diaphragm segment 22 (and components included therein) requires removal of the upper half of the casing, along with upper diaphragm segment 20 (FIG. 2). Further, because support bar 32 couples lower diaphragm segment 22 to casing 30, and due to the presence of a centering pin (not shown) coupling the diaphragm to the casing, lower diaphragm segment 22 cannot be rotated around rotor 29 (FIG. 2) while housed within casing 30 (due to a lack of clearance). Due to this limited clearance, the positioning of bolts 34 in support bars 32, and the presence of the centering pin, the lower diaphragm segment 22 must be removed vertically from casing 30 in order to access support bars 32. This requires removing rotor 29, and subsequently lifting lower diaphragm segment 22 vertically in order to remove bolts 34. This process is both time consuming and costly.

FIGS. 4-7 show several embodiments of support bars that are adjustable from a position above the horizontal joint surface 24. These support bars may also be referred to as centerline support bars. In any case, as described herein, these support bars may create particular constraints for retrofitting existing turbomachines.

Figure 4:
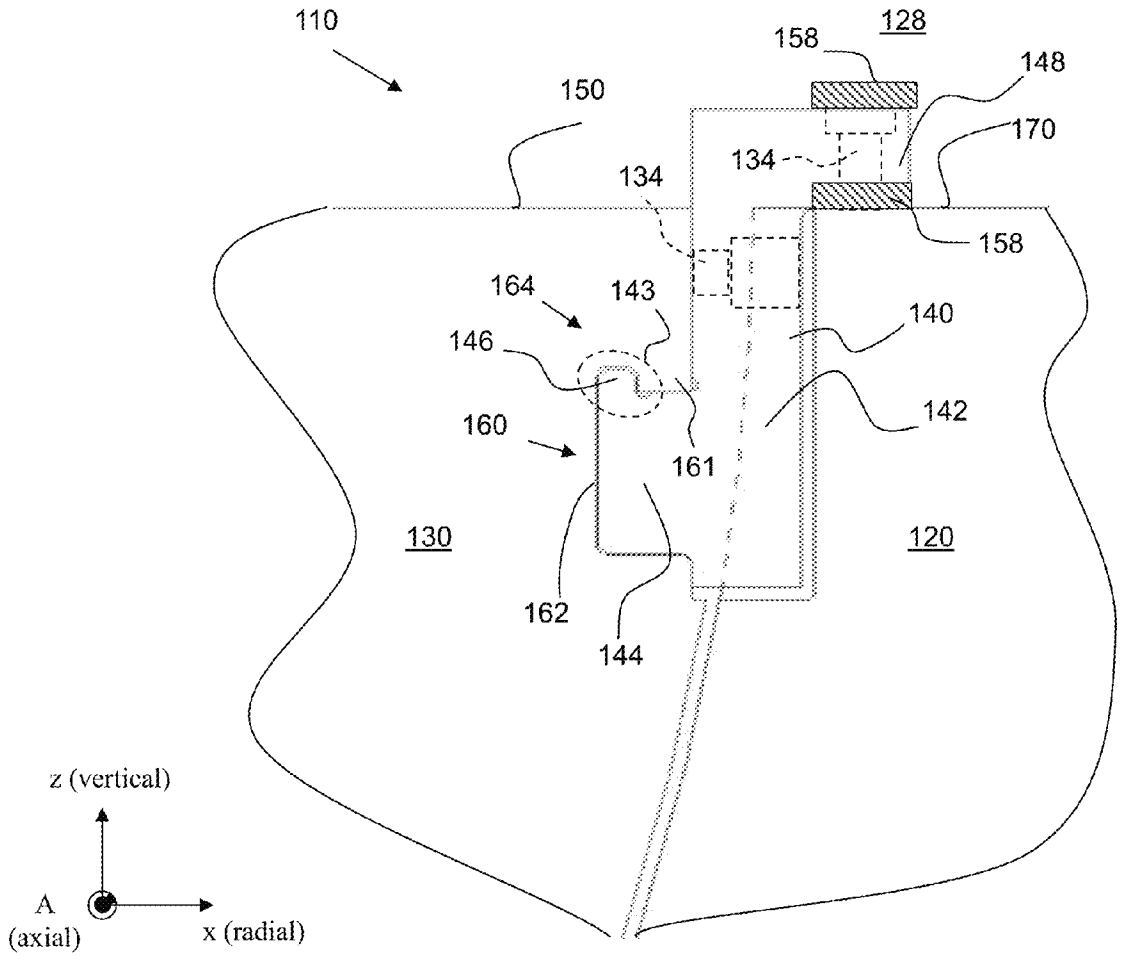
FIGS. 4-7 show a partial end elevation of steam turbine nozzle support assemblies according to embodiments.

Turning to FIG. 4, a steam turbine nozzle support assembly 110 is shown according to an embodiment of the invention. As used herein, the directional key in the lower left-hand portion of FIGS. 4-7 is provided for ease of reference. As shown, this key is oriented with respect to the close-up views of portions of steam turbine support assemblies described herein. For example, as used in FIGS. 4-7, which show front views of steam turbine support assemblies, the "z" axis represents vertical (or radial) orientation, "x" represents horizontal (or radial) orientation, and the "A" axis (into and out of the page) represents axial orientation (along the axis of the turbine rotor, omitted for clarity). As used herein, the terms "axial" and/or "axially" refer to the relative position/direction of objects along axis A, which is substantially parallel with the axis of rotation of the turbomachine (in particular, the rotor section). As further used herein, the terms "radial" and/or "radially" refer to the relative position/direction of objects along axis (x), which is substantially perpendicular with axis A and intersects axis A at only one location. Additionally, the terms "circumferential" and/or "circumferentially" refer to the relative position/direction of objects along a circumference which surrounds axis A but does not intersect the axis A at any location.

In one embodiment, steam turbine nozzle support assembly 110 includes a steam turbine casing half (or simply, casing) 120 and a semi-annular diaphragm segment 130 at least partially housed within casing 120. Also shown in FIG. 4 is a support bar 140 which may include a hook-shaped portion (or simply, hook) 143 (indicated by phantom circle) for engaging a lip portion (or simply, lip) 161 of semi-annular diaphragm segment 130. For illustrative purposes, an upper steam turbine casing half (or simply, upper casing) 128 is also shown. As described further herein, in some embodiments, upper casing 128 may be formed with a slot to receive an upper flange (e.g., upper flange 148) of a support bar (e.g., support bar 140). As described further herein, support bar 140 is configured to non-affixedly join casing 120 to semi-annular diaphragm segment 130. In other words, the configuration of support bar 140 including hook 143 allows it to be removably arranged between steam turbine casing 120 and semi-annular diaphragm segment 130 such that support bar 140 is not affixed to either of casing 120 or semi-annular diaphragm segment 130 (e.g., by bolts, screws, adhesive, or other fixation mechanisms).

However, despite not being affixed to either of steam turbine diaphragm 130 or steam turbine casing 120, support bar 140 including hook 143 is configured to at least partially join steam turbine diaphragm 130 to steam turbine casing 120.

As indicated above, support bar 140 may include hook-shaped portion 143. In one embodiment, hook-shaped portion 143 may include any arced, angled, or curved portion of support bar 140 capable of non-affixedly engaging lip portion 161 of semi-annular diaphragm segment 130. As is described further herein, in one embodiment, hook-shaped portion 143 may include portions of one or more flanges, bosses, or protrusions.

With continuing reference to FIG. 4, semi-annular diaphragm segment 130 includes a horizontal joint surface 150 and a slot 160. Slot 160 may include a first portion 162 extending substantially parallel to horizontal joint surface 150, and a second portion 164 extending substantially perpendicularly from first portion 162. As shown, portions (including e.g., hook 143) of support bar 140 may complement first portion 162 and second portion 164 of slot 160. For example, as shown in FIG. 4, support bar 140 may include a body portion 142, a first flange (or boss) 144 extending substantially perpendicularly from body portion 142, and a second flange (or boss) 146 extending substantially perpendicularly from first flange 144. First flange 144 and second flange 146 may collectively form hook 143. Hook 143 may non-affixedly engage lip portion 161 of semi-annular diaphragm segment 130, where lip portion 161 may be a flange, boss, or other protrusion extending from semi-annular diaphragm segment toward slot 160. In one embodiment, lip portion 161 may extend away from horizontal joint surface 150 downwardly (in the z direction).

As is further shown in FIG. 4, in one embodiment, support bar 140 may include a fourth flange (or simply, upper flange) 148 extending substantially perpendicularly from body portion 142 and radially outwardly over an upper surface 170 of casing 120. In other words, upper flange 148 may extend from body portion 142 in a direction opposite of hook-shaped portion 143 to engage upper surface 170. As will be described further herein, upper flange 148 may allow for e.g., an operator or maintenance personnel to adjust the position of horizontal joint surface 150 relative to upper surface 170. That is, adjustment of the position of upper flange 148 may allow for alignment of horizontal joint surface 150 and upper surface 170. This may be performed, for example, by inserting a shim 158 between upper surface 170 and upper flange 148 to separate upper flange 148 from upper surface 170. In the case where incremental adjustment of the position of upper flange 148 is desirable, shim 158 may be accessed (and, e.g., later machined) without removing semi-annular diaphragm segment 130 and rotor (e.g., rotor 29 of FIG. 2). As noted above, upper flange 148 may function as an overhanging support mechanism for support bar 140, and may allow for alignment of horizontal joint surface 150 and upper surface 170. Upper flange 148 may further eliminate the need for a first shim and bolt mechanism (e.g., shim 44 and bolt 34 shown in FIG. 3) below horizontal joint surface 150 and upper surface 170 to hold support bar 140 in its operative position. Further shown in this embodiment is an additional shim 158, which may be placed between an upper surface of upper flange 148, and a lower surface of upper casing half 128 (shown partially in phantom). This additional shim 158 may further aid in keeping support bar 140 in its proper position during operation of a steam turbine including steam turbine nozzle assembly 110.

As noted above, embodiments of support bar 140 including upper flange 148 may not include a bolt 134 affixing support bar 140 to semi-annular diaphragm segment 130. In these embodiments, hook 143 may be a unitary structure without apertures therethrough. Where support bar 140 does not include these bolts 134 extending therethrough, greater clearance is created for bolts (not shown) to extend downwardly (in the z direction) through horizontal joint surface 150 and into semi-annular diaphragm segment 130. This may allow for larger (longer, thicker) bolts and bolt holes (or other coupling mechanisms) to couple semi-annular diaphragm segment 130 to an upper semi-annular diaphragm segment (e.g., diaphragm ring segment 20 of FIG. 2). Additionally, support bar 140 including upper flange 148 may reduce clearance concerns caused by bolts or shims (e.g., shim 44 of FIG. 3) located below horizontal joint surface 150. During operation of the steam turbine, temperatures below horizontal joint surface 150 may be greater than those at the surface. The greater temperatures below the surface may cause thermal expansion of components such as shims or bolts. This thermal expansion may adversely affect adjustment of a support bar. In the case where shims 158 are located above horizontal joint surface 150 (and upper surface 170), the thermal expansion effects may be reduced.

Although the support bar 140 of FIG. 4, along with other support bars shown and described herein, are capable of non-affixedly joining casing 120 to semi-annular diaphragm segment 130, use of bolts to secure one or more portions of support bar 140 to at least one of casing 120 and semi-annular diaphragm segment 130 is still possible. As shown in phantom in FIG. 4, bolts 134 may optionally be used to affix one or more portions of support bar to semi-annular diaphragm segment 130. Further, although hook 143 is shown (in phantom circle), alternate embodiments of the disclosure may include a support bar including an upper flange (e.g., upper flange 148), but without hook 143 (e.g., without second flange 146). In these cases, bolts 134 may be used to affix the body 142 and/or first flange 144 of support bar 140 to semi-annular diaphragm segment 130. In this case, upper flange 148 may still allow e.g., an operator or maintenance personnel to align horizontal joint surface 150 and upper surface 170 without removing semi-annular diaphragm segment 130. Bolts 134 are shown in FIGS. 4-7 in phantom indicating that bolts 134 may optionally be used in those embodiments as well.

As is further shown in FIG. 4, upper casing half 128 may be formed with a slot, bend, groove, etc. for receiving upper flange 148 and one or more shims 158 placed therebetween. Additionally, in an optional embodiment, one or more shims 158 may be joined to upper flange 148 via a bolt 134, the bolt 134 being accessible from above upper surface 170. Shims 158 may include, for example, a low chrome (Cr) steel, a chromium-nickel-tungsten-cobalt alloy, or any other material resistant to wear and known in the art.

As is shown in FIG. 4, in one embodiment, first flange 144 may be complementary to first portion 162 of slot 160 and second flange 146 may be complementary to second portion 164 of slot 160. Similarly, hook 143 may be complementary to a portion of lip 161 (e.g., engaging a radially inward portion of lip 161). It is understood that as used herein, the term "complementary" refers to a relationship between surfaces in which portions of those surfaces may be arranged substantially aligned with one another. For example, in one embodiment, surfaces of first flange 144 may be arranged substantially aligned with a wall of the first portion 162 of slot 160. Further, surfaces of second flange 146 may be arranged substantially aligned with a wall of the second portion 164 of slot 160.

Figure 5:
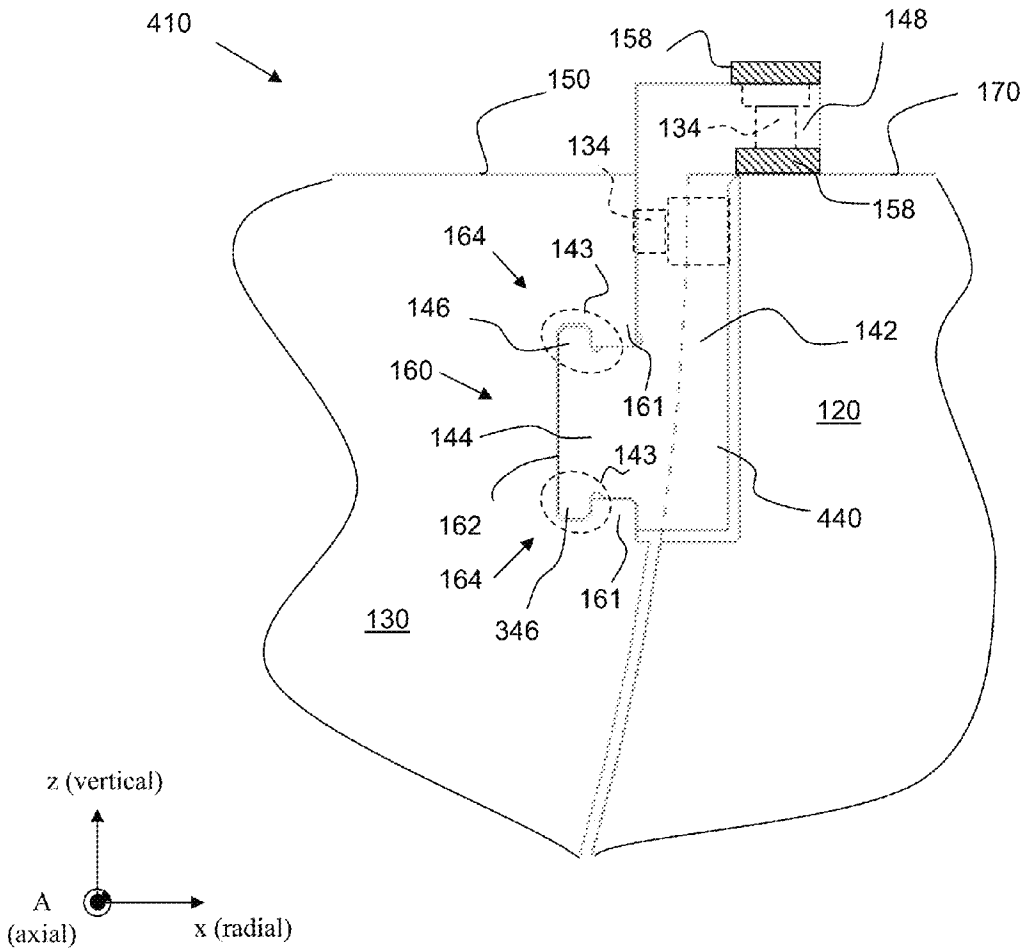

Turning to FIG. 5, a steam turbine nozzle assembly 410 is shown according to another embodiment. This embodiment may combine features shown and described with reference to previously-discussed figures, and more specifically, steam turbine nozzle assembly 410 may include an upper flange 148 and an upper shim 158 (as shown and described with reference to FIG. 4). Further, steam turbine nozzle assembly 410 may include a support bar 440, which may include a body portion 142 and hooks 143. Hook 143 may include portions of a first flange 144 extending substantially perpendicularly from the body portion 142, and a second flange 146 extending substantially perpendicularly from first flange 144. As shown, second portion 164 of slot 160 extends from first portion 162 of slot 160 in two opposing directions. As also shown, support bar 340 may further include a third flange 346 (forming part of additional hook 143, shown in phantom circle) extending substantially perpendicularly from first flange 144 and in an opposite direction from second flange 146. In this embodiment, as with the steam turbine nozzle assembly 110 shown and described with reference to FIG. 4, support bar 440 is demountably joined to semi-annular diaphragm segment 130 in an axial direction (A) and is adjustable (e.g., via access to shims 158) from a point above upper surface 170 and horizontal joint surface 150. Further, in the embodiment where support bar 440 is not bolted to semi-annular diaphragm segment 130 (e.g., in the x direction), greater clearance is afforded for bolting at the horizontal joint surface 150. It is also understood that in an alternative embodiment, support bar 440, similarly to support bar 140 of FIG. 4, may be formed without hooks 143, and may use one or more bolts 134 to secure support bar to semi-annular diaphragm segment 130.

Figure 6:
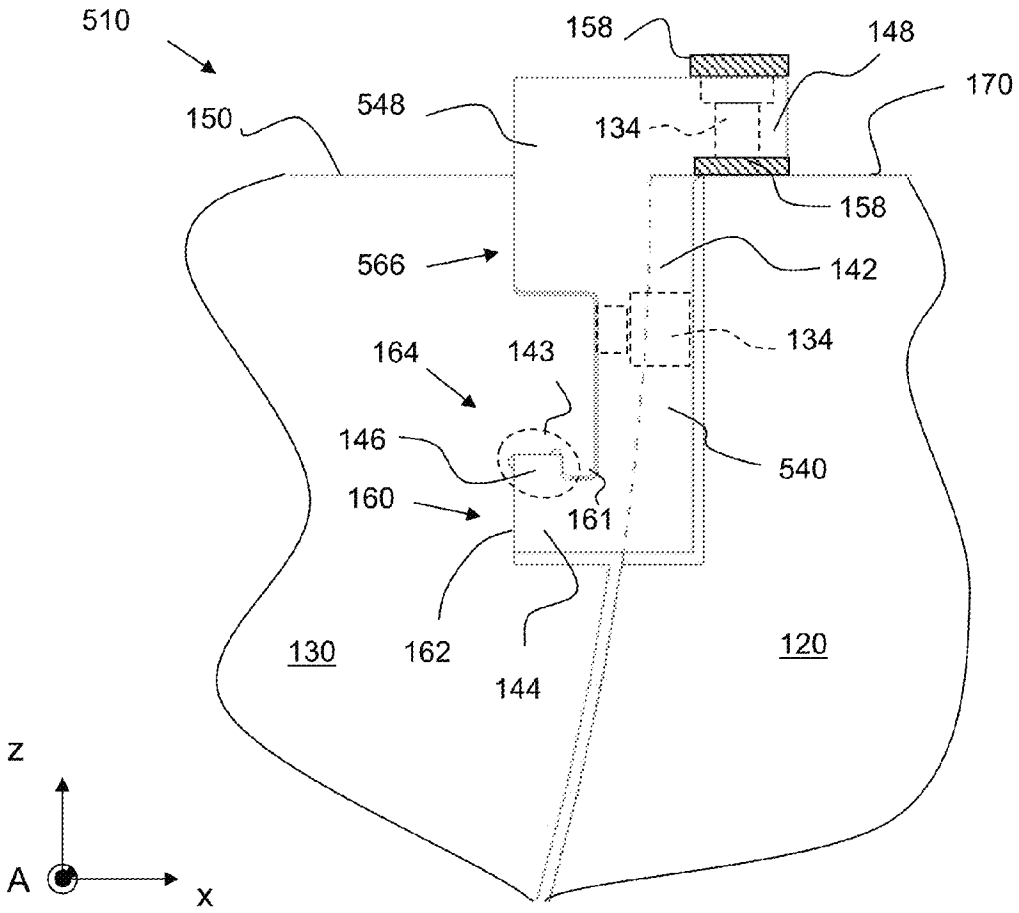

Turning to FIG. 6, a steam turbine nozzle assembly 510 is shown according to another embodiment. This embodiment may include features shown and described with reference to FIG. 4, as well as additional features. For example, steam turbine nozzle assembly 510 may include a support bar 540, which, similarly to support bar 140 (FIG. 4), may include a body portion 142 and a hook 143. Hook 143 may include portions of a first flange 144 extending substantially perpendicularly from body portion 142, and a second flange 146 extending substantially perpendicularly from first flange 144. In this embodiment, support bar 540 may further include a third flange 548 extending substantially perpendicularly from body portion 142 and radially inwardly over a seat 566 within the semi-annular diaphragm segment 130. Third flange 548 may further extend above (e.g., in the z-direction) horizontal joint surface 150. In this case, a second (or upper) semi-annular diaphragm ring segment (e.g., segment 20 of FIG. 2) may include a slot or opening (not shown) for receiving the portion of third flange 548 extending above the horizontal joint surface 150. As shown, seat 566 includes a surface distinct from the first and second portions of slot 160 (and similarly, lip 161). That is, support bar 540 may partially surround (e.g., contact on three sides) a portion of semi-annular diaphragm segment 130. Support bar 540 may also include a fourth flange (or simply, upper flange) 148, similarly shown and described with reference to FIG. 4 (along with upper shim 158). In this embodiment, as with steam turbine nozzle assemblies 110, 410 shown and described with reference to FIGS. 4 and 5, support bar 540 is demountably joined to semi-annular diaphragm segment 130 in an axial direction (A) and is adjustable (e.g., via access to shims 158) from a point above upper surface 170 and horizontal joint surface 150. Further, in the embodiment where support bar 540 is not bolted to semi-annular diaphragm segment 130 (e.g., in the x direction), greater clearance is afforded for bolting at the horizontal joint surface 150. It is also understood that in an alternative embodiment, support bar 540, similarly to support bar 140 of FIG. 4, may be formed without hooks 143, and may use one or more bolts 134 to secure support bar to semi-annular diaphragm segment 130.

Figure 7:
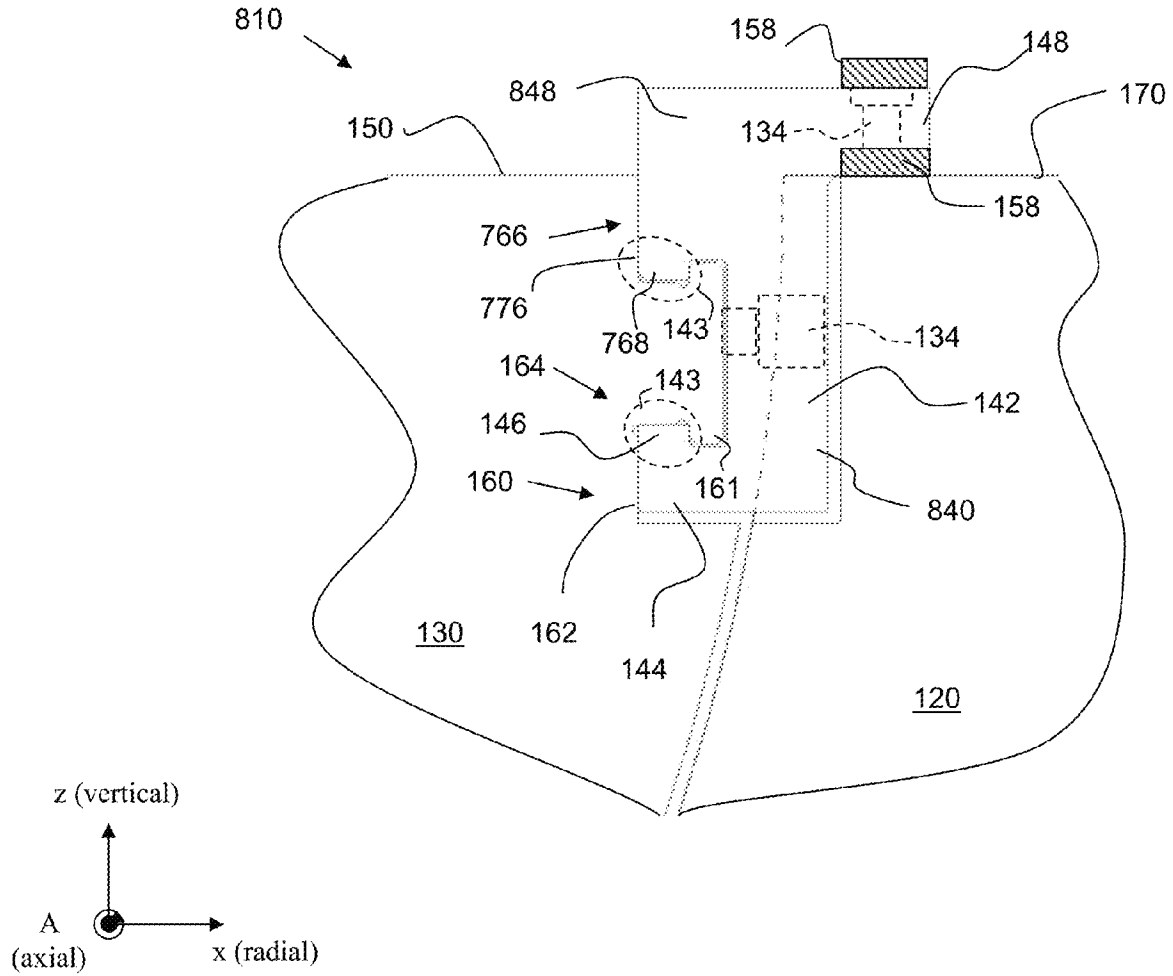

Turning to FIG. 7, a steam turbine nozzle assembly 810 is shown according to another embodiment. For example, steam turbine nozzle assembly 810 may include a support bar 840, which may include a body portion 142 and a hook 143. Hook 143 may include portions of a first flange 144 extending substantially perpendicularly from body portion 142, and a second flange 146 extending substantially perpendicularly from first flange 144. In this embodiment, support bar 840 may further include a third flange 848 (forming part of an additional hook 143) extending substantially perpendicularly from body portion 142 and radially inwardly over a seat 766 within semi-annular diaphragm segment 130. Third flange 848 may further extend above (e.g., in the z-direction) horizontal joint surface 150. In this case, a second (or upper) semi-annular diaphragm ring segment (e.g., segment 20 of FIG. 2) may include a slot or opening (not shown) for receiving the portion of third flange 848 extending above horizontal joint surface 150. As shown, seat 766 includes a surface distinct from the first and second portions of slot 160. Further, seat 766 may include a recess 776 for receiving a fourth flange 768 (forming part of additional hook 143). Support bar 840 may also include a fifth flange (or simply, upper flange) 148, along with upper shim 158. In this embodiment, as with the steam turbine nozzle assembly 110 shown and described with reference to FIG. 4, support bar 840 is demountably joined to semi-annular diaphragm segment 130 in an axial direction (A) and is adjustable (e.g., via access to shims 158) from a point above upper surface 170 and horizontal joint surface 150. Further, in the embodiment where support bar 840 is not bolted to semi-annular diaphragm segment 130 (e.g., in the x direction), greater clearance is afforded for bolting at the horizontal joint surface 150. It is also understood that in an alternative embodiment, support bar 840, similarly to support bar 140 of FIG. 4, may be formed without hooks 143, and may use one or more bolts 134 to secure support bar to semi-annular diaphragm segment 130.

While the above-noted support bar designs are able to significantly reduce the amount of time spent in the turbine maintenance cycle, incorporating these newer support bar designs into existing turbomachinery without requiring removal of the diaphragm lower half can present challenges. For example, the existing casing design may provide inadequate support for the support bar, compromising its stability, and stabilizing that support bar may require access to the casing that can only be accomplished by the timely and costly removal of the lower diaphragm half. It is also undesirable to weld a support block to the casing, due to stress concentrations in the weld proximate the support bar, and the potential for weld degradation.

According to various embodiments of the disclosure, a casing support block is provided which allows for retrofit of an existing turbomachine casing to accommodate the above-noted overhanging support bar (several types discussed). Further, this casing support block can be integrated into existing turbomachine casings without requiring removal of the lower diaphragm half According to various embodiments of the disclosure, a casing support block includes a main body sized to pocket in the casing, and a set of axially (in the direction of the axis of rotation of the turbomachine) extending tabs (projections) sized to complement a set of axially extending slots connected with the casing pocket. The axially extending tabs can serve at least two purposes: a) the tab(s) can aid in positioning/placement of the casing support block within the casing; and b) the tab(s) can retain the position of the casing support block within the casing. In particular, during a shutdown of the turbomachine, the diaphragm section will tend to cool more quickly than the casing section, and as such, the diaphragm may pull away from the casing during this cooling. This pulling may cause the diaphragm, via the support bar, to pull on the casing support block. Were the casing support block welded to the casing, this pulling effect could create significant stresses on the weld.

In order to combat this pulling effect, casing support blocks shown and described according to embodiments of the disclosure include axially extending tabs, which help to retain the position of the casing support block in the casing pocket. Additionally, in some embodiments, the casing support block includes a pin hole on its bottom surface for receiving a retaining member (e.g., pin, bolt, etc.) protruding from the bottom of the casing pocket. The retaining member (e.g., pin, bolt, etc.), can be manufactured by inserting a partially threaded bolt or pin into the existing hole in the bottom of the slot, where the male threaded portion of the bolt or pin engages the female (internal) threads in the existing hole, leaving the non-threaded section of the bolt or pin sitting within the slot to engage the pin hole on the casing support block.

Some embodiments include a casing support block with only one tab. This single-tab configuration may be beneficial where space for more than one tab (e.g., two tabs) is not feasible. In this case, the single tab may be larger than each of the tabs in the multi-tab configuration in order to provide sufficient stability for the casing support block.

Another embodiment of the disclosure includes a casing support block with a main body sized to complement the casing pocket, further including a downward-facing hook on the radially outward side of the main body, which engages an upward-facing hook (or groove) machined into the casing, radially outward of the casing pocket. The interaction of the hooks can help to stabilize the casing support block, and in some cases, this casing support block can also include a pin hole for engaging a pin/bolt as described with respect to other casing support blocks herein.

Figure 8:
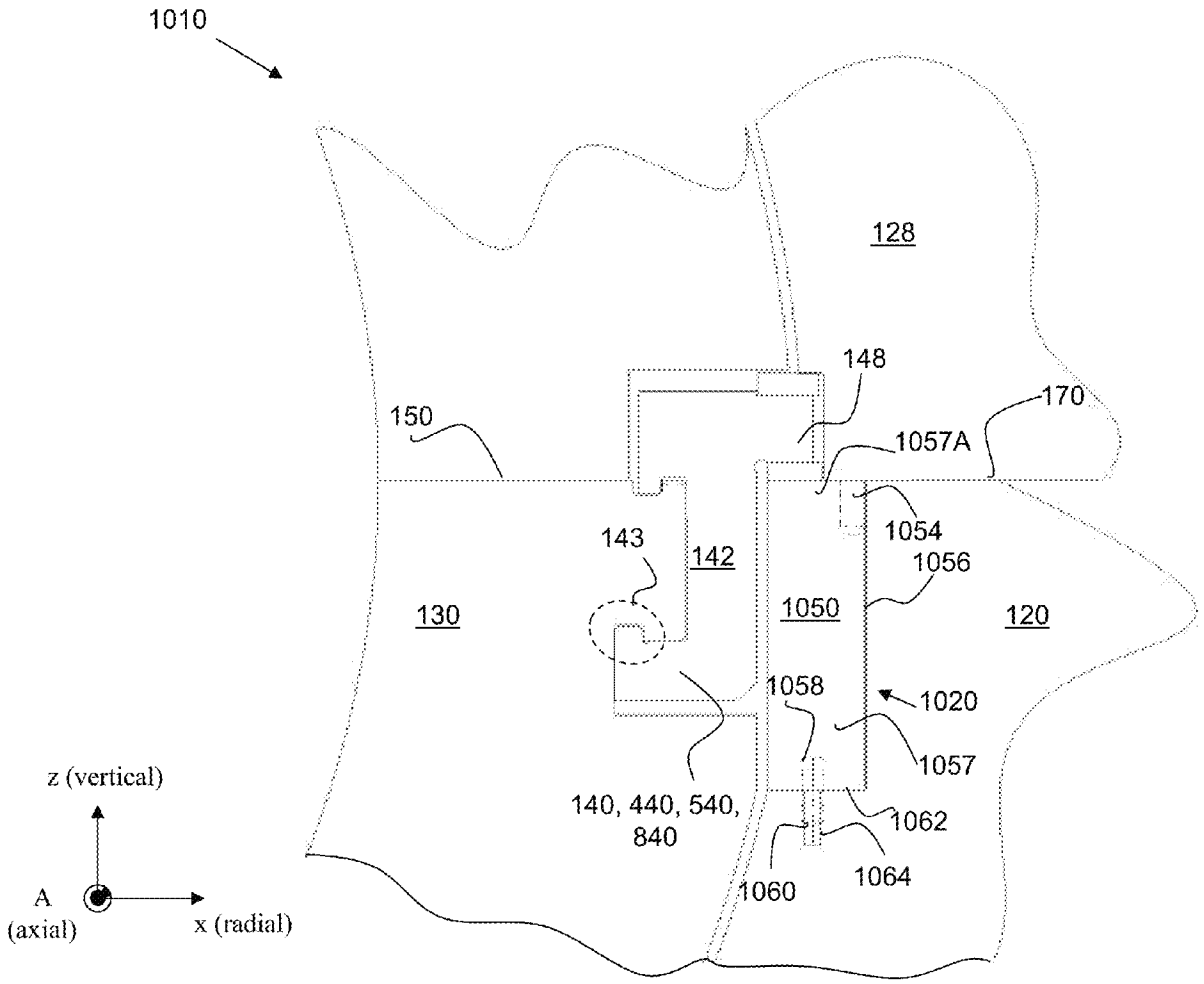
FIG. 8 shows a partial end elevation of a steam turbine nozzle support assembly according to various embodiments of the disclosure.
Figure 9:
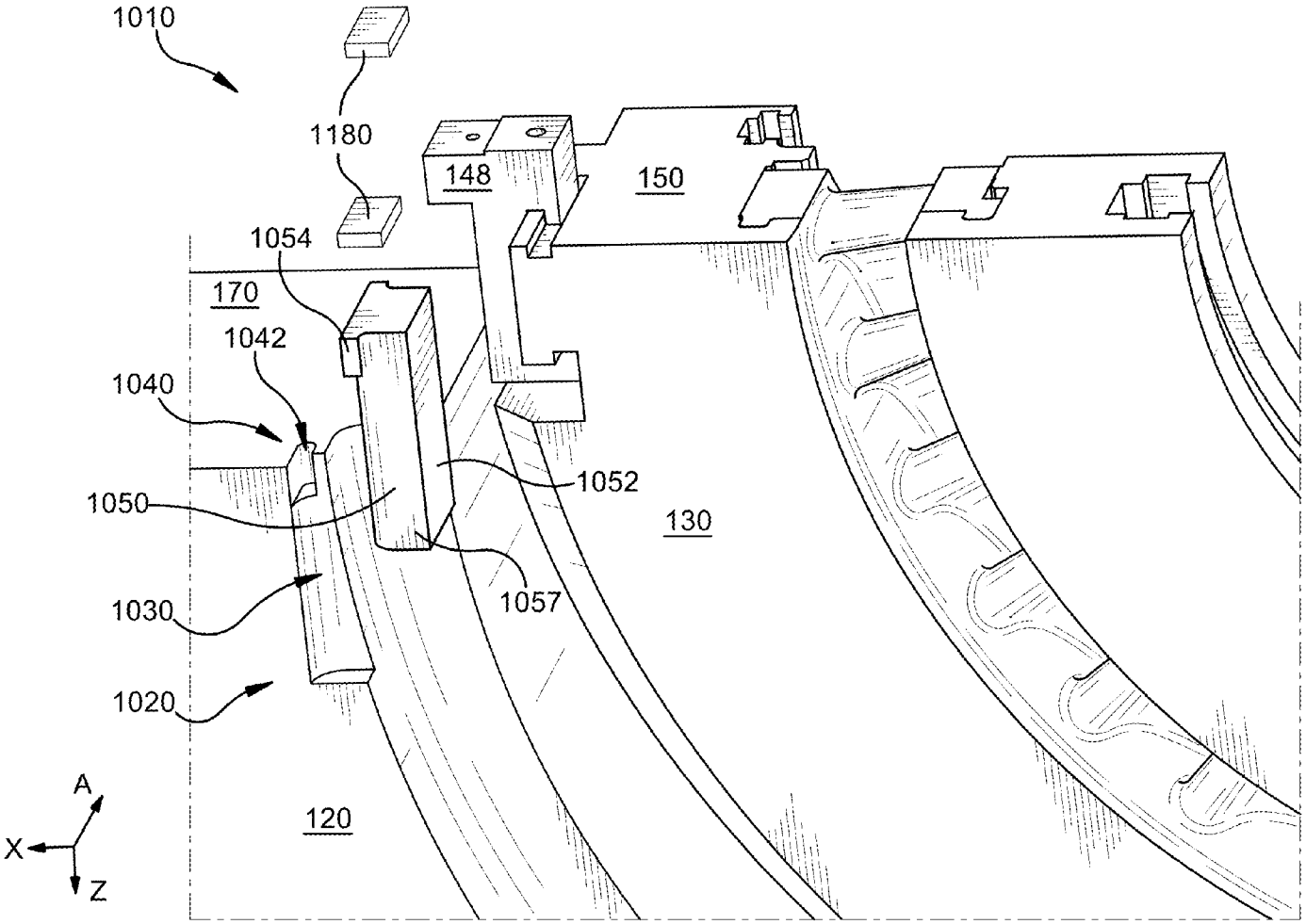
FIGS. 9-11 show three-dimensional perspective views of portions of the steam turbine nozzle support assembly of FIG. 8.
Figure 10:
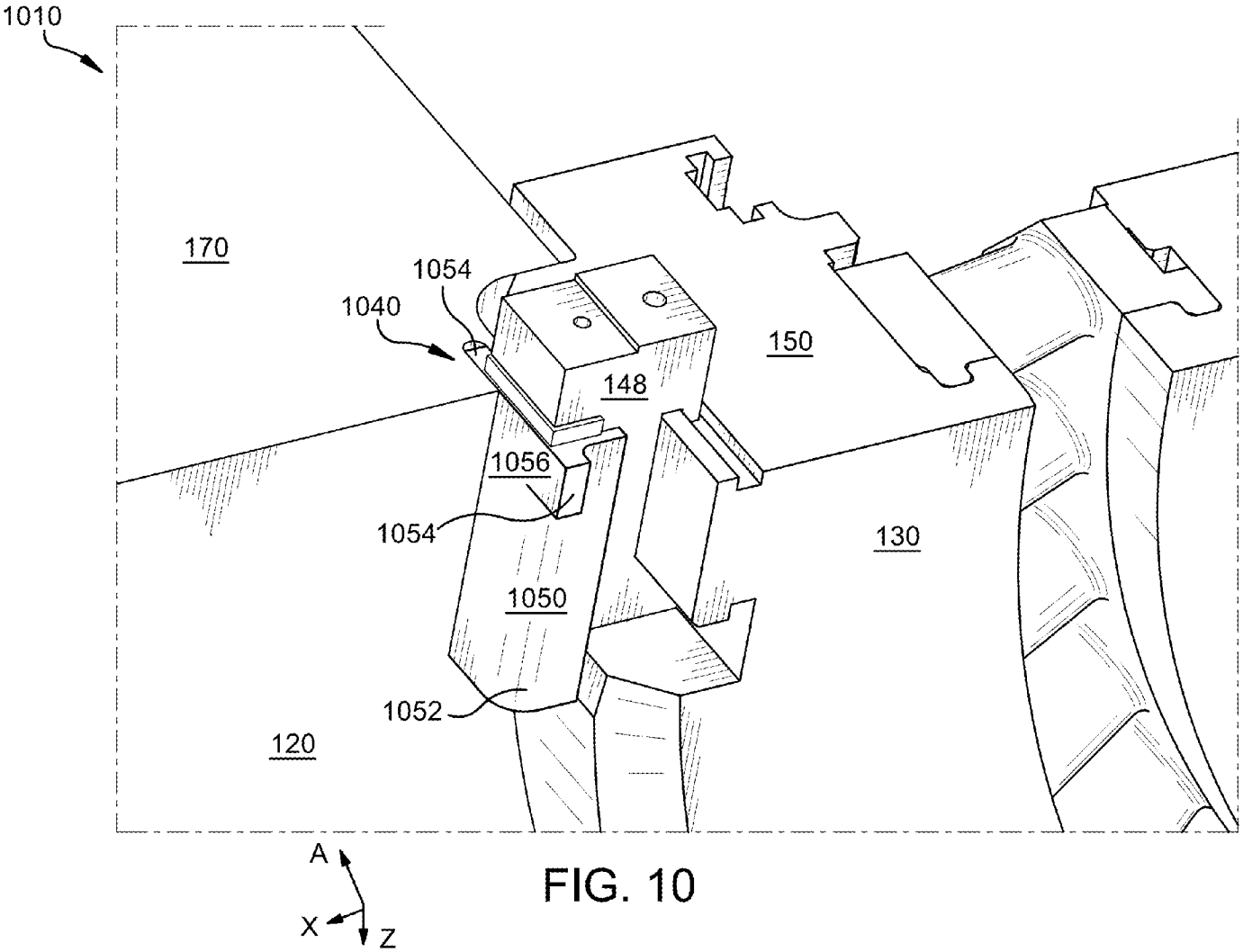
Figure 11:
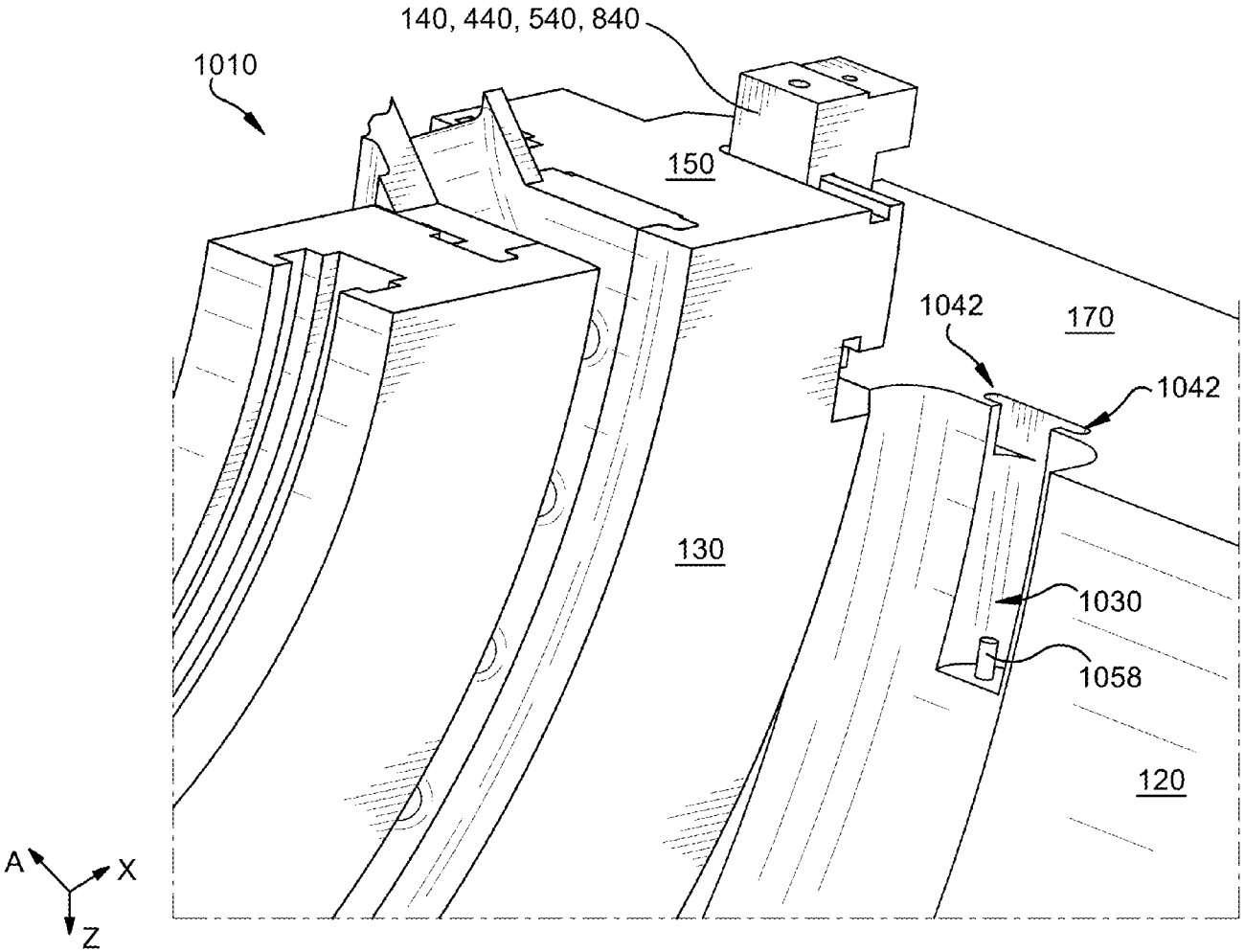
Figure 12:
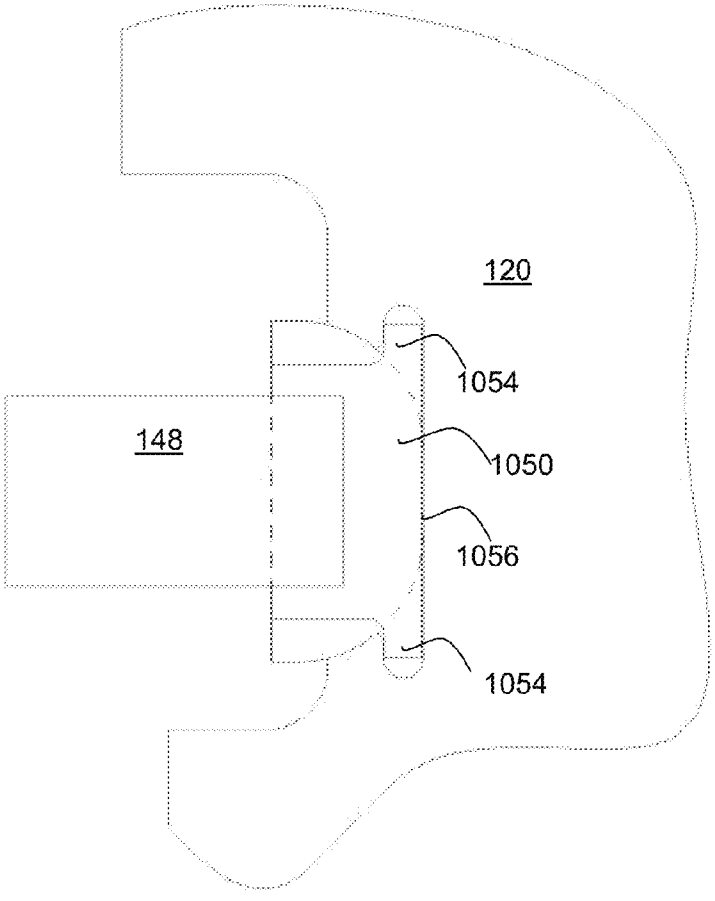
FIG. 12 shows a plan view of a portion of the steam turbine nozzle support assembly of FIGS. 8-11.

FIG. 8 shows an end view of a steam turbine nozzle support assembly 1010, including a steam turbine casing support block 1020 according to various embodiments of the disclosure. FIG. 9 shows a three-dimensional perspective view of the steam turbine nozzle support assembly 1010, deconstructed for the purposes of discussion of individual components of that assembly. FIG. 10 shows a three-dimensional perspective view of the steam turbine nozzle support assembly 1010 from a distinct perspective as FIG. 9. FIG. 11 shows a three-dimensional perspective view of the steam turbine nozzle support assembly 1010 of FIGS. 8-10, without the steam turbine casing support block 1020. FIG. 12 shows a top view of a portion of the steam turbine nozzle support assembly 1010 of FIGS. 8-10.

It is understood that commonly labeled elements in the FIGURES may denote common features of those elements. Redundant explanation and labeling is omitted for the purposes of clarity of illustration.

Turning to FIGS. 8-12, the steam turbine nozzle support assembly (nozzle support assembly) 1010 can include a semi-annular diaphragm segment 130, as described herein. The nozzle support assembly 1010 can further include a steam turbine casing (or, casing) (segment) 120, which according to various embodiments, has a horizontal joint surface 170 and a pocket 1020 below the horizontal joint surface 170. The pocket 1020 can include a main pocket 1030 and at least one slot 1040 extending from the main pocket 1030. According to various embodiments, the at least one slot 1040 includes two distinct axially extending slots 1042, each extending in opposing directions axially from the main pocket 1030. In other embodiments, the at least one slot 1040 includes a single, axially extending slot 1040 extending from the main pocket 1030.

According to various embodiments, the nozzle support assembly 1010 further includes a steam turbine casing support block (support block) 1050, which supports a steam turbine nozzle support bar 140, 440, 540, 840. The support block 1050 can include a body portion 1052 sized to substantially fill the pocket 1020 in the casing 120. That is, the body portion 1052 is sized to substantially fill the main pocket 1030. The body portion 1052 can have a greater length (vertically shown in this orientation) than an axial depth (along axis (a)) or a radial width (across axis (r)). In some cases, the length of the body portion (height in z-direction when upright) is approximately 10 centimeters to approximately 15 centimeters (e.g., approximately 4 inches to approximately 6 inches, in particular cases, approximately 5 inches), the radial width is approximately 4 to approximately 8 centimeters (e.g., approximately 1.5 to approximately 3 inches, in particular cases, approximately 2.5 inches), and the axial depth is approximately 5 centimeters to approximately 10 centimeters (e.g., approximately 2 inches to approximately 4 inches, in particular cases, approximately 3 inches).

The support block 1050 can further include a set of tabs 1054 extending from the body portion 1052, where each of the set of tabs 1054 is sized to substantially fill a corresponding slot (e.g., at least one slot 1040) in the casing 120. As show, the set of tabs 1054 are located at (extending in part from, or adjacent to) a radially outwardly facing wall 1056 of the body portion 1052.

In various embodiments, the set of tabs 1054 includes two distinct tabs 1054, each extending from opposing axially facing walls 1057 of the body portion 1052. The radially outwardly facing wall 1056, is adjacent to, and extends between, the opposing axially facing walls 1057. In various embodiments, the set of tabs 1054 extends from only a portion of each of the opposing axially facing walls 1057, leaving a portion 1057A of each of the opposing axially facing walls 1057 otherwise exposed.

In other embodiments, the set of tabs 1054 includes a single tab 1054 extending from one of the axially facing walls 1057 (e.g., FIG. 8) of the body portion 1052. In these cases, as described herein, the pocket 1020 may only include a single slot 1042 for receiving the single tab 1054.

In some embodiments, the support block 1050 can further include a pin hole 1058 on a bottom surface 1062 of the body portion 1052, for receiving a retaining member 1060. In various embodiments, the hole 1058 is a cavity within the body portion 1052 with an opening at the bottom surface 1062 of the body portion 1052. The hole 1058 may be internally threaded in some embodiments for receiving an internally threaded retaining member 1060. However, in various embodiments, the hole 1058 is not internally threaded, and instead, has an approximately smooth inner surface sized to complement the retaining member 1060, which protrudes upward from a slot 1064 in the casing 120. The slot 1064 is located in the bottom of the main pocket 1030 for engaging the hole 1058, and inhibiting movement of the support block 1050, e.g., during differential cooling of components in the assembly 1010.

The nozzle support assembly 1010 can further include a support bar 140, 440, 540, 840 (or any other support bar including overhang support described herein) non-affixedly engaging the semi-annular diaphragm segment 130. As noted herein, the support bar 140, 440, 540, 840 includes flange 148 overhanging the horizontal joint surface 170 of the steam turbine casing 120. As described herein, the support bar 140 can further overhang the steam turbine casing support block 1050. The nozzle support assembly 1010 can further include a shim 1180 located between the steam turbine casing support block 1050 and the flange 148 overhanging the horizontal joint surface 170 of the steam turbine casing 120. An additional shim 1180 can be located over the flange 148, where each shim may allow for incremental adjustment of the position of the support bar 140, 440, 540, 840, and consequently, the diaphragm section 130, relative to the casing 120, without requiring access below the horizontal joint surfaces 150, 170. As is known in the art, the shims 1180 can be machined, replaced with different shims, etc., to modify their size in the positions indicated in the disclosure, in order to modify a position of the diaphragm segment 130 relative to the casing 120.

Figure 13:
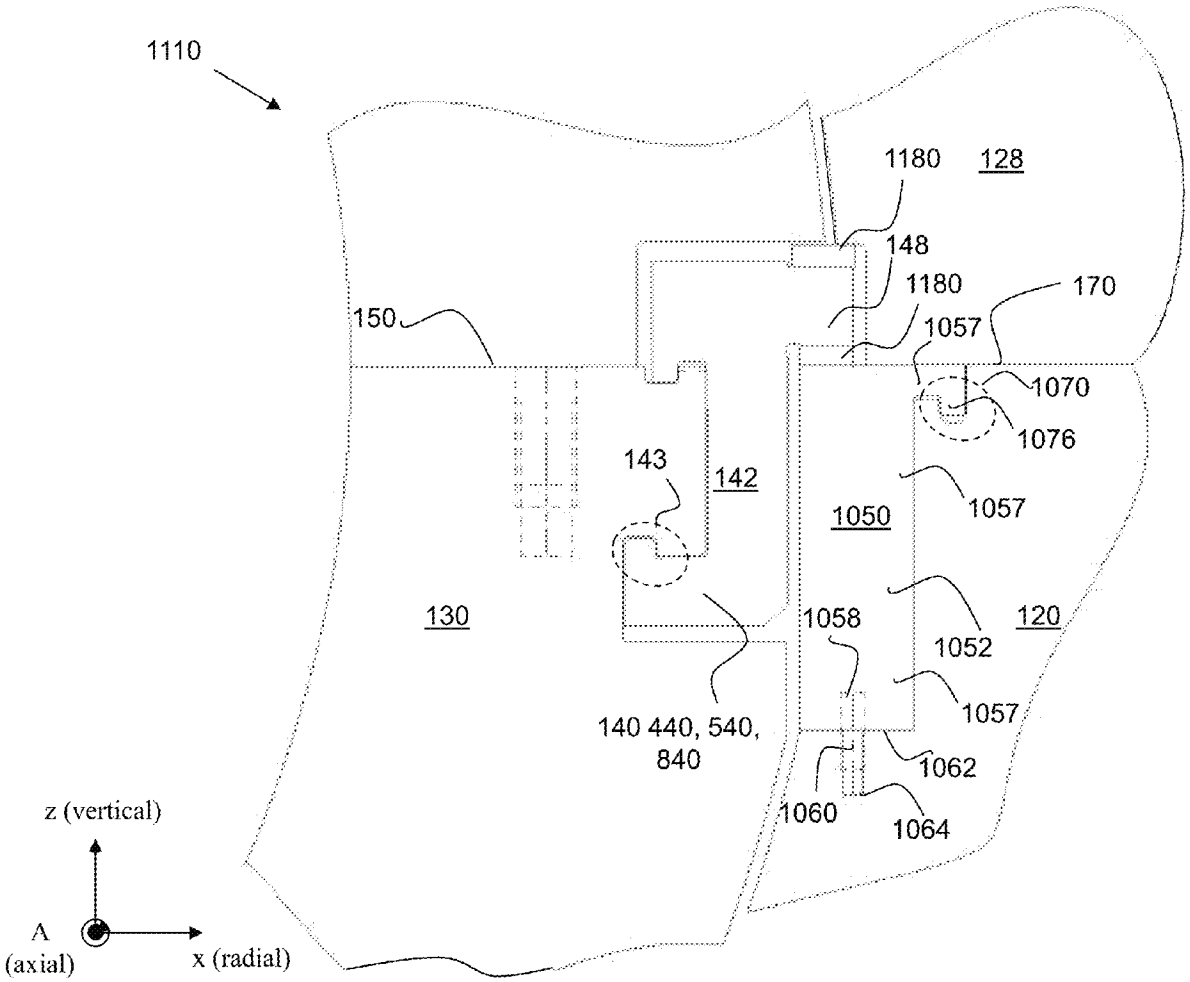
FIG. 13 shows a partial end elevation of a steam turbine nozzle support assembly according to various additional embodiments of the disclosure.

FIG. 13 shows an end view of a nozzle support assembly 1110 according to various other embodiments, where the set of tabs 1054 includes a hook 1070 extending from the radially outwardly facing wall 1056, where the hook 1070 is sized to complement a corresponding slot (e.g., hook-shaped slot) 1072 in the casing 120. In various embodiments, hook 1070 can be substantially similar to hook 143 (described herein), and include a first flange 1074 extending substantially perpendicularly from the main body portion 1052, and a second flange 1076 extending substantially perpendicularly from the first flange 1074.

In any case, as shown and described herein, each of the set of tabs 1054 is a unitary structure formed from a common material as the body portion 1052. In various embodiments, the set of tabs 1054 and the body portion 1052 are formed simultaneously as a single support member 1050, e.g., via casting or forging.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A steam turbine casing support block comprising:

a body portion sized to substantially fill a pocket in a steam turbine casing, the body portion having a greater length than an axial depth or a radial width;

a set of tabs extending from the body portion, each of the set of tabs sized to substantially fill a corresponding slot in the steam turbine casing, wherein the set of tabs are located at a radially outwardly facing wall of the body portion, wherein the set of tabs includes two distinct tabs each extending from opposing axially facing walls of the body portion, wherein the radially outwardly facing wall extends between the opposing axially facing walls of the body portion; and a pin hole on a bottom surface of the body portion for receiving a retaining member.

2. The steam turbine casing support block of claim 1, wherein a length of the body portion is approximately 10 centimeters to approximately 15 centimeters, a radial width of the body portion is approximately 4 centimeters to approximately 8 centimeters, and an axial depth is approximately 5 centimeters to approximately 10 centimeters.

3. The steam turbine casing support block of claim 1, wherein the set of tabs extends from only a portion of each of the opposing axially facing walls, leaving a portion of each of the opposing axially facing walls exposed.

4. The steam turbine casing support block of claim 1, wherein the set of tabs further includes a hook extending from the radially outwardly facing wall, the hook sized to complement a corresponding slot in the casing.

5. The steam turbine casing support block of claim 4, wherein the hook includes:

a first flange extending substantially perpendicularly from the body portion; and a second flange extending substantially perpendicularly from the first flange.

6. The steam turbine casing support block of claim 1, wherein each of the set of tabs is a unitary structure formed from a common material as the body portion.

7. A steam turbine nozzle support assembly comprising:

a semi-annular diaphragm segment;

a steam turbine casing at least partially housing the semi-annular diaphragm segment, the steam turbine casing having a horizontal joint surface and a pocket below the horizontal joint surface, the pocket including a main pocket and at least one slot extending from the main pocket;

a steam turbine casing support block having:

a body portion sized to substantially fill the main pocket; and a set of tabs extending from the body portion, each of the set of tabs sized to substantially fill the at least one slot extending from the main pocket, wherein the set of tabs are located at a radially outwardly facing wall of the body portion; and a support bar non-affixedly engaging the semi-annular diaphragm segment, the support bar including a flange overhanging the horizontal joint surface of the steam turbine casing and the steam turbine casing support block.

8. The steam turbine nozzle support assembly of claim 7, further comprising:

a hole on a bottom surface of the body portion; and a retaining member protruding from a bottom of the main pocket for engaging the hole in the body portion of the steam turbine casing support block.

9. The steam turbine nozzle support assembly of claim 7, further comprising a shim located between the steam turbine casing support block and the flange overhanging the horizontal joint surface of the steam turbine casing.

10. The steam turbine nozzle support assembly of claim 7, wherein the set of tabs includes two distinct tabs each extending from opposing axially facing walls of the body portion, wherein the radially outwardly facing wall extends between the opposing axially facing walls of the body portion, and wherein the at least one slot extending from the main pocket includes two distinct slots extending in axially opposing directions from the main pocket, the two distinct tabs complementing the two distinct slots.

11. The steam turbine nozzle support assembly of claim 7, wherein the set of tabs extends from only a portion of each of the opposing axially facing walls.

12. The steam turbine nozzle support assembly of claim 7, wherein the set of tabs includes a single tab extending from an axially facing wall of the body portion, the axially facing wall being adjacent the radially outwardly facing wall, and wherein the at least one slot extending from the main pocket includes a single slot extending in an axial direction from the main pocket, the single tab complementing the single slot.

13. The steam turbine nozzle support assembly of claim 7, wherein the set of tabs includes a hook extending from the radially outwardly facing wall, wherein the at least one slot includes a hook-shaped slot, wherein the hook is sized to complement the hook-shaped slot in the casing.

14. The steam turbine nozzle support assembly of claim 13, wherein the hook includes:

a first flange extending substantially perpendicularly from the body portion; and a second flange extending substantially perpendicularly from the first flange.

15. The steam turbine nozzle support assembly of claim 1, wherein each of the set of tabs is a unitary structure formed from a common material as the body portion.

16. A steam turbine apparatus comprising:

a rotor;

a semi-annular diaphragm segment at least partially surrounding the rotor;

a steam turbine casing at least partially housing the semi-annular diaphragm segment and the rotor, the steam turbine casing having a horizontal joint surface and a pocket below the horizontal joint surface, the pocket including a main pocket and at least one slot extending from the main pocket;

a steam turbine casing support block having:

a body portion sized to substantially fill the main pocket; and a set of tabs extending from the body portion, each of the set of tabs sized to substantially fill the at least one slot extending from the main pocket, wherein the set of tabs are located at a radially outwardly facing wall of the body portion; and a support bar non-affixedly engaging the semi-annular diaphragm segment, the support bar including a flange overhanging the horizontal joint surface of the steam turbine casing and the steam turbine casing support block.

17. The steam turbine apparatus of claim 16, further comprising:

a hole on a bottom surface of the body portion; and a retaining member protruding from a bottom of the main pocket for engaging the hole in the body portion of the steam turbine casing support block.

18. The steam turbine casing support block of claim 1, wherein the pin hole is sized to receive a retaining member.

19. The steam turbine casing support block of claim 18, wherein the pin hole is internally threaded, and wherein the retaining member is threaded.

* * * * *